US009751121B2

(12) United States Patent
Murphy

(10) Patent No.: US 9,751,121 B2
(45) Date of Patent: Sep. 5, 2017

(54) PIPE STRAIGHTENING APPARATUS AND A METHOD OF STRAIGHTENING A PIPE

(76) Inventor: Matthew Murphy, Cheshire (GB)

( * ) Notice: Subject to any disclaimer, the term of this patent is extended or adjusted under 35 U.S.C. 154(b) by 272 days.

(21) Appl. No.: 14/116,738

(22) PCT Filed: May 9, 2012

(86) PCT No.: PCT/GB2012/051012
§ 371 (c)(1),
(2), (4) Date: Jan. 23, 2014

(87) PCT Pub. No.: WO2012/153129
PCT Pub. Date: Nov. 15, 2012

(65) Prior Publication Data

US 2014/0150512 A1 Jun. 5, 2014

(30) Foreign Application Priority Data

May 9, 2011 (GB) ..... 1107673.4

(51) Int. Cl.
*B21D 3/04* (2006.01)
*B21D 3/05* (2006.01)
*B21F 1/02* (2006.01)

(52) U.S. Cl.
CPC ..... *B21D 3/04* (2013.01); *B21D 3/05* (2013.01); *B21F 1/02* (2013.01)

(58) Field of Classification Search
CPC .. B21B 17/14; B21D 3/02; B21D 3/04; B21D 3/05; B21D 3/08
See application file for complete search history.

(56) References Cited

U.S. PATENT DOCUMENTS 3,568,485 A * 3/1971 Mandula, Jr. ..... G01N 27/82 33/501.03
4,534,197 A * 8/1985 Woolley ..... B21D 3/04 72/98

(Continued)

FOREIGN PATENT DOCUMENTS

DE 1032066 B 6/1958
DE 29809163 U1 10/1998

(Continued)

OTHER PUBLICATIONS

EP0051950 A2 is attached.*

(Continued)

*Primary Examiner* — Peter DungBa Vo
*Assistant Examiner* — John S Lowe
(74) *Attorney, Agent, or Firm* — Leydig, Voit & Mayer, Ltd

(57) ABSTRACT

A pipe straightening apparatus comprising a first set of rotatably mounted elements which define, at least in part, a first passageway through which a pipe can be constrained to pass, so as to straighten the pipe, wherein the first set of rotatably mounted elements are arranged such that when a pipe translates within the first passageway, relative to the apparatus, the first set of rotatably mounted elements roll along the pipe, relative to the pipe, in a direction which has a component in the circumferential direction of the pipe and a second set of rotatably mounted elements which define, at least in part, a second passageway through which a pipe can pass, wherein the second set of rotatably mounted elements are arranged such that when a pipe translates within the second passageway, relative to the apparatus, the second set of rotatably mounted elements roll along the pipe, relative to the pipe, in a direction that is substantially parallel to the longitudinal axis of the pipe.

21 Claims, 14 Drawing Sheets

(56) References Cited

U.S. PATENT DOCUMENTS

| | | | | | |
|---|---|---|---|---|---|
| 5,442,946 | A * | 8/1995 | Yokoo | B21B 1/18 | 72/235 |
| 2002/0162373 | A1 * | 11/2002 | Schramm | B21D 3/05 | 72/162 |

FOREIGN PATENT DOCUMENTS

| | | | | |
|---|---|---|---|---|
| EP | 0051950 | A2 | 5/1982 | |
| EP | 0567647 | A1 | 11/1993 | |
| GB | EP 0051950 | A2 * | 5/1982 | B21D 3/04 |

OTHER PUBLICATIONS

European Patent Office, International Search Report in International Patent Application No. PCT/GB2012/051012 (Oct. 17, 2012).

* cited by examiner

PIPE STRAIGHTENING APPARATUS AND A METHOD OF STRAIGHTENING A PIPE

CROSS-REFERENCE TO RELATED APPLICATIONS

This patent application is the U.S. national phase of International Application No. PCT/GB2012/051012, filed on May 9, 2012, which claims the benefit of United Kingdom Patent Application No. 1107673.4, filed May 9, 2011, the disclosures of which are incorporated by reference.

The present invention relates to a pipe straightening apparatus and a to method of straightening a pipe.

In domestic and industrial plumbing situations it is often necessary to attempt to straighten copper piping, used in water supply systems, gas supply systems and central heating systems, so that it runs neatly and uniformly in a given space, e.g. through a roof void or along a skirting board. Also, in vehicle systems, including classic cars, brake and fuel lines also typically use metallic pipes. Metallic piping is also used in piping for instrumentation for connecting gauges and the like.

Copper (or other soft metal) piping is usually provided in a coiled form and needs to be straightened by the fitter before use. The length of piping which is coiled can be several meters long. It is difficult to adequately straighten the piping by hand, particularly if it has been bent more than is strictly necessary to conform with the coil.

At present, plumbers and installers generally attempt to straighten pipe by hand, since it is relatively easy to bend manually. However, the aesthetic appearance of such manually straightened pipe is not ideal and can result in practical problems as well, when attempting to secure significant lengths of pipe to, for instance, a joist, rafter or skirting board.

Embodiments of the present invention seek to address shortcomings and problems in the prior art, whether identified herein or not.

According to a first aspect of the present invention there is provided a pipe straightening apparatus, comprising a frame and a plurality of pipe-engaging wheels, said plurality of pipe engaging wheels being arranged in a plurality of groups, each group comprising a linear array of wheels.

Preferably each wheel is arranged to have a substantially concave section at its perimeter.

Preferably the apparatus is arranged to be manually operable.

Preferably each wheel rotates about an axle, said axle being used to couple a first part of the frame to a second part of the frame.

Preferably the plurality of groups comprises 3 or 4 groups.

Preferably each group comprises 4 wheels.

Preferably the frame is separable into two portions such that the two portions can be re-attached around a pipe where no pipe-end is accessible.

Preferably each wheel is arranged such that its axle is non-perpendicular to the frame, thereby causing, in use, the apparatus to rotate about the pipe as it is propelled along the pipe.

According to a second aspect of the present invention there is provided a method of straightening a pipe using a pipe straightening apparatus comprising the steps of: introducing a free end of the pipe into the apparatus; and propelling the apparatus along a length of the pipe, causing a plurality of wheels disposed within the apparatus to contact the pipe from different radial directions, thereby substantially straightening the pipe.

Preferably the method comprises the repeated propelling back and forth to achieve the desired substantial straightening.

Preferably, where no free end of the pipe is accessible, the method comprises the steps of: placing two mutually attachable portions of a pipe-straightening apparatus around the section of pipe to be straightened; mutually attaching the two portions; and propelling the apparatus along a length of the pipe, causing a plurality of wheels disposed within the apparatus to contact the pipe from different radial directions, thereby substantially straightening the pipe.

When straightening a pipe, it is known to rotate a pipe as it passes through a pipe straightening device. In this regard, European patent application no. 81305037.4 (OPENGLEAD LIMITED) discloses a machine for straightening pipes comprising a plurality of rollers arranged to define a passageway through which a pipe can be constrained to pass so as to straighten the pipe and wherein the axes of rotation of the rollers are inclined at a non-perpendicular angle to the longitudinal axis of the passageway such that as a pipe passes through the passageway, the pipe rotates within the passageway. However, it is not known how to produce a hand-held pipe-straightening device that is able to rotate relative to a pipe, as it travels along the pipe.

In addition, once a pipe has been straightened, it is often subsequently bent in order to suit a particular application. It is often difficult to produce a uniform bend in the pipe, resulting in inconsistency of performance of the pipe, and a poor appearance.

Embodiments of the present invention also seek to address these problems.

According to a third aspect of the present invention there is provided a pipe straightening apparatus comprising a first set of rotatably mounted elements which define, at least in part, a first passageway through which a pipe can be constrained to pass, so as to straighten the pipe, wherein the first set of rotatably mounted elements are arranged such that when a pipe translates within the first passageway, relative to the apparatus, the first set of rotatably mounted elements roll along the pipe, relative to the pipe, in a direction which has a component in the circumferential direction of the pipe and a second set of rotatably mounted elements which define, at least in part, a second passageway through which a pipe can pass, wherein the second set of rotatably mounted elements are arranged such that when a pipe translates within the second passageway, relative to the apparatus, the second set of rotatably mounted elements roll along the pipe, relative to the pipe, in a direction that is substantially parallel to the longitudinal axis of the pipe.

This is advantageous in that the apparatus can be used to both straighten a pipe and to draw a substantially straight reference line along a pipe.

In order to straighten a pipe, the pipe is passed through the first passageway, i.e. the pipe is translated within the first passageway, relative to the apparatus. As the apparatus translates relative to the pipe, it also rotates relative to the pipe. This is advantageous in that a greater surface area of the pipe is contacted, and thereby straightened, by the rotatably mounted elements, thereby producing a better result.

In order to draw a substantially straight reference line along a pipe, the pipe is passed through the second passageway. As the pipe translates within the second passageway, relative to the apparatus, the second set of rotatably mounted elements roll along the pipe, relative to the pipe, in a direction which is substantially parallel to the longitudinal axis of the second passageway and which does not have a component in the circumferential direction of the pipe, i.e. the apparatus does not rotate relative to the pipe as it translates relative to the pipe.

This allows a marking means, such as a drawing implement, to be included as part of or attached to the apparatus and arranged to draw a straight line on the pipe as a pipe translates within the second passageway, relative to the apparatus. The reference line can be used, for example, during subsequent bending of the pipe to ensure that a uniform bend is applied.

Furthermore, the applicant has identified that as the rotatably mounted elements travel along the pipe, acting to straighten the outer surface of the pipe, a corresponding grooved passageway is created on the opposing region of the inner surface of the pipe. Accordingly, as the rotatably mounted elements spiral along the pipe, a spiral grooved passageway is created on the inside of the pipe. This is advantageous in that the passageway acts to direct liquid (e.g. water) flowing through the pipe. Accordingly, the liquid tends to flow in the direction of the spiral passageway, thereby creating a spiralling flow of liquid. This maintains the direction of flow of liquid through the pipe, which acts to maintain laminar flow, thereby reducing turbulence in the flow. Accordingly, energy lost to turbulent flow is decreased, as are the associated increase in drag forces created by turbulent flow. Therefore, less energy (i.e. a lower pressure differential) is required to maintain a certain flow rate through the pipe. The invention therefore not only straightens pipes, but also increases the efficiency of the pipes, resulting in improved economy of operation of the pipes.

Preferably the axes of rotation of the rotatably mounted elements of the first set are inclined at a non-perpendicular angle to the longitudinal axis of the first passageway. This is advantageous in that the apparatus rotates relative to the pipe as it translates relative to the pipe. Accordingly, the rotatably mounted elements of the first set define a "corkscrew" path as they roll along the pipe.

In addition, sections of pipe located in any gaps in the circumferential direction, between the rotationally mounted elements, are straightened by the rotatably mounted elements as they rotate about the pipe.

Preferably the first set of rotatably mounted elements comprises at least two rotatably mounted elements.

Preferably the axes of rotation of the rotatably mounted elements of the first set are non-parallel to the longitudinal axis of the first passageway.

Preferably the axis of rotation of each rotatably mounted element of the first set is substantially perpendicular to an axis that extends substantially perpendicular from the longitudinal axis of the first passageway and passes through the centre of the respective wheel.

Preferably the axis of rotation of each rotatably mounted element of the first set is inclined relative to a line extending substantially perpendicular to the longitudinal axis of the first passageway, about an axis that is both substantially perpendicular to said line and to the longitudinal axis of the first passageway, in the same rotational direction when viewed looking towards the longitudinal axis of the first passageway.

Preferably the axis of rotation of each rotatably mounted element of the first set is inclined relative to a line that passes through the centre of the respective rotatably mounted element, is substantially perpendicular to the longitudinal axis of the first passageway and is substantially perpendicular to an axis that extends substantially perpendicular from the longitudinal axis of the first passageway and passes through the centre of the respective rotatably mounted element, about said axis. Preferably the angle of inclination from said line, is in the same rotational direction about said axis, when viewed looking towards the longitudinal axis of the first passageway. Preferably said angle of inclination is substantially the same for each rotatably mounted element of the first set. Preferably said angle is in the range 1 to 2 degrees. Preferably each rotatably mounted element of the first and/or second sets comprise a curved peripheral surface. Preferably said curved peripheral surface is concavely curved. Preferably said curved peripheral surface has a substantially constant radius.

Preferably respective surfaces of the first set of rotatably mounted elements define at least longitudinal sections of the first passageway. Preferably respective surfaces of the first set of rotatably mounted elements define at least circumferential sections of the first passageway. Preferably respective surfaces of the first set of rotatably mounted elements substantially define the circumferential shape of the first passageway.

Preferably respective surfaces of the rotatably mounted elements of the first set are arranged to contact a pipe in the first passageway from different circumferential positions relative to the pipe.

Preferably said respective surfaces of the rotatably mounted elements are said respective curved peripheral surfaces.

Preferably the rotatably mounted elements of the first set are arranged such that their respective curved peripheral surfaces are disposed at different circumferential positions relative to the longitudinal axis of the first passageway and lie along a curve of substantially constant radius. Preferably the rotatably mounted elements of the first set are arranged such that their respective curved peripheral surfaces line along the curved surface of a cylinder.

Preferably said first set comprises at least one group of said rotatably mounted elements disposed at different circumferential positions relative to the longitudinal axis of the first passageway and substantially aligned in a direction substantially perpendicular to the longitudinal axis of the first passageway. Preferably the rotatably mounted elements of the at least one group are substantially equally spaced in the circumferential direction, about said longitudinal axis. Preferably corresponding points on the rotatably mounted elements of the at least one group are disposed along a plane that is substantially perpendicular to the longitudinal axis of the first passageway. Preferably the centres of the rotatably mounted elements of the at least one group are disposed along a plane that is substantially perpendicular to the longitudinal axis of the first passageway.

Preferably the respective curved peripheral surfaces of the rotatably mounted elements of the at least one group define a substantially circular cross-sectional shape.

Preferably said at least one group comprises at least two rotatably mounted elements. The at least one group may comprise three or four rotatably mounted elements.

Preferably said first set comprises a plurality of said groups, disposed at different positions along the longitudinal axis of the first passageway. Preferably the first set of rotatably mounted elements comprises four said groups of rotatably mounted elements.

Preferably corresponding rotatably mounted elements of different said groups are substantially aligned in the circumferential direction relative to the longitudinal axis of the first passageway. Preferably the centres of corresponding rotatably mounted elements in each group are aligned along a line substantially parallel to longitudinal axis of first passageway. Preferably each group contains the same number of rotatably mounted elements.

Preferably the axes of rotation of the rotatably mounted elements of the second set are either substantially perpendicular to the longitudinal axis of the second passageway or, where the axis of rotation of at least one of the rotatably mounted elements of the second set is not substantially perpendicular to the longitudinal axis of the second passageway, the axis of rotation of at least one other rotatably mounted element of the second set is inclined relative to the longitudinal axis of the second passageway such that when a pipe translates within the second passageway, relative to the apparatus, the second set of rotatably mounted elements roll along the pipe, relative to the pipe, in a direction which is substantially parallel to the longitudinal axis of the second passageway.

This is advantageous as it cancels out any rolling motion in the circumferential direction of the pipe, as the pipe passes through the second passageway.

Preferably the axis of rotation of the at least one other rotatably mounted element of the second set is inclined relative to the longitudinal axis of the second passageway in a different direction to said at least one rotatably mounted element. Preferably the axis of rotation of the at least one other rotatably mounted element of the second set is inclined relative to the longitudinal axis of the second passageway by substantially the same angle as the at least one rotatably mounted element, in a different direction.

Preferably said at least one rotatably mounted element of the second set is disposed at a different circumferential position to said at least one other rotatably mounted element, relative to the longitudinal axis of the second passageway. Preferably said at least one rotatably mounted element of the second set is disposed on an opposed side of the longitudinal axis of the second passageway to said at least one other rotatably mounted element.

Preferably the axes of rotation of the rotatably mounted elements of the second set are substantially perpendicular to the longitudinal axis of the second passageway.

Preferably the axes of rotation of the rotatably mounted elements of the second set are substantially perpendicular to respective axis that extends substantially perpendicular from the longitudinal axis of the second passageway and passes through the centre of the respective wheel.

Preferably the second set of rotatably mounted elements comprises first and second rotatably mounted elements disposed at different positions in the direction of the longitudinal axis of the second passageway, wherein said first and second rotatably mounted elements have axes of rotation in different directions such that when a pipe translates within the second passageway, relative to the apparatus, the second set of rotatably mounted elements roll along the pipe, relative to the pipe, in a direction which is substantially parallel to the longitudinal axis of the second passageway.

Preferably respective surfaces of the second set of rotatably mounted elements define at least longitudinal sections of the second passageway. Preferably respective surfaces of the second set of rotatably mounted elements define at least circumferential sections of the second passageway. Preferably respective surfaces of the second set of rotatably mounted elements substantially define the circumferential shape of the second passageway.

Preferably respective surfaces of the rotatably mounted elements of the second set are arranged to contact a pipe in the second passageway from different circumferential positions relative to the pipe.

Preferably said respective surfaces of the rotatably mounted elements are said respective curved peripheral surfaces.

Preferably the rotatably mounted elements of the second set are arranged such that their respective curved peripheral surfaces are disposed at different circumferential positions relative to the longitudinal axis of the second passageway.

Preferably said second set comprises at least one group of said rotatably mounted elements disposed at different circumferential positions relative to the longitudinal axis of the second passageway and substantially aligned in a direction substantially perpendicular to the longitudinal axis of the second passageway. Preferably the rotatably mounted elements of the at least one group are substantially equally spaced in the circumferential direction, about said longitudinal axis. Preferably corresponding points on the rotatably mounted elements of the at least one group are disposed along a plane that is substantially perpendicular to the longitudinal axis of the second passageway. Preferably the centres of the rotatably mounted elements of the at least one group are disposed along a plane that is substantially perpendicular to the longitudinal axis of the second passageway.

Preferably the respective curved peripheral surfaces of the rotatably mounted elements of the at least one group define a substantially circular cross-sectional shape.

Preferably said at least one group comprises two rotatably mounted elements.

Preferably said second set comprises a plurality of said groups, disposed at different positions along the longitudinal axis of the second passageway. Preferably the second set of rotatably mounted elements comprises two said groups of rotatably mounted elements.

Preferably corresponding rotatably mounted elements of different said groups are substantially aligned in the circumferential direction relative to the longitudinal axis of the second passageway. Preferably the centres of corresponding rotatably mounted elements in each group are aligned along a line substantially parallel to longitudinal axis of second passageway. Preferably each group contains the same number of rotatably mounted elements.

The first and second sets of rotatably mounted elements preferably comprise at least one common rotatably mounted element. Preferably all of the rotatably mounted elements of the second set are also of the first set.

Accordingly, the axes of rotation of the rotatably mounted elements of the second sets are preferably inclined at a non-perpendicular angle to the longitudinal axis of the first passageway and are substantially perpendicular to the longitudinal axis of the second passageway.

Preferably the respective longitudinal axes of the first and second passageways are substantially perpendicular.

Preferably the first set comprises first and second said groups disposed on opposed sides of the longitudinal axis of the second passageway. Preferably the first and second groups are adjacent to each other.

Preferably the second set comprises first and second said groups disposed on opposed sides of the longitudinal axis of the first passageway. Preferably the first and second groups are adjacent to each other.

Preferably the apparatus comprises a marking means arranged to mark a pipe as it passes translates through the second passageway relative to the apparatus.

Preferably the marking means is a drawing implement. More preferably the marking means is a pen or pencil.

Preferably the rotatably mounted elements of said first and second sets are wheels or rollers.

Preferably the pipe has a substantially circular cross-sectional area. Preferably the pipe is substantially cylindrical in shape.

Preferably the apparatus comprises a frame, on which the rotatable mounted elements of the first and second sets are rotatably mounted. Preferably the frame comprises a plurality of elongate sections having a substantially 'L-shaped' cross-section.

Preferably the pipe straightening apparatus is sized and configured to be hand-held during use.

According to a fourth aspect of the present invention there is provided a method of use of a pipe straightening apparatus according to the third aspect of the present invention comprising receiving a pipe within the first passageway of the apparatus, translating the pipe within the first passageway, relative to the apparatus, so as to straighten the pipe, receiving a pipe within the second passageway, translating the pipe within the second passageway, relative to the apparatus and marking a substantially straight line on the pipe as it passes through the second passageway.

Where the apparatus comprises said marking means, the line is preferably marked on the pipe using the marking means.

It is known to use a pipe straightening machine comprising a two opposed rows wheels to define a passageway through which a pipe can be constrained to pass, so as to straighten the pipe. Such a pipe straightening machine is disclosed in CN 2117956U (Metallurg Constructure).

However, such a machine is not suitable for handheld use due to the high frictional forces between the pipe and the contacting surfaces of the wheels.

Embodiments of the present invention also seek to address these problems.

According to a fifth aspect of the present invention there is provided a pipe straightening apparatus comprising a first set of rotatably mounted elements which define, at least in part, a first passageway through which a pipe can be constrained to pass, so as to straighten the pipe, wherein said first set comprises at least one group of rotatably mounted elements disposed at different circumferential positions relative to the longitudinal axis of the first passageway and substantially aligned in a direction substantially perpendicular to the longitudinal axis of the first passageway, said at least one group of rotatably mounted elements having respective curved peripheral surfaces which are arranged to contact a pipe in the first passageway from different circumferential positions relative to the pipe and wherein said at least one group comprises at least three rotatably mounted elements.

Since the at least one group comprises at least three rotatably mounted elements, the frictional forces between the rotatably mounted elements and the pipe being straightened are decreased, relative to the above two wheel arrangement, due to the greater surface area of contact between the rotatably mounted elements and the pipe. Accordingly, the apparatus can be suitable for hand held use, i.e. a person can propel the apparatus to translate relative to a pipe within the first passageway, so as to straighten the pipe.

Preferably said group comprises three rotatably mounted elements.

Preferably said group comprises four rotatably mounted elements.

Preferably the rotatably mounted elements of the at least one group are substantially equally spaced in the circumferential direction, about said longitudinal axis.

Preferably the respective curved peripheral surfaces of the rotatably mounted elements of the at least one group is concavely curved.

Preferably the respective curved peripheral surfaces of the rotatably mounted elements of the at least one group has a substantially constant radius.

Preferably the curved peripheral surfaces of the rotatably mounted elements of the at least one group define a substantially circular cross-sectional shape.

Preferably said first set comprises a plurality of said groups, disposed at different positions along the longitudinal axis of the first passageway.

Preferably the first set of rotatably mounted elements are arranged such that when a pipe translates within the first passageway, relative to the apparatus, the first set of rotatably mounted elements roll along the pipe, relative to the pipe, in a direction which has a component in the circumferential direction of the pipe.

Preferably the axes of rotation of the rotatably mounted elements of the first set are inclined at a non-perpendicular angle to the longitudinal axis of the first passageway.

Preferably the frame is separable into two portions such that the two portions can be re-attached around a pipe where no pipe-end is accessible.

Preferably the rotatably mounted elements of the first set are wheels.

All of the features described herein may be combined with any of the above aspects, in any combination.

For a better understanding of the invention, and to show how embodiments of the same may be carried into effect, reference will now be made, by way of example, to the accompanying diagrammatic drawings in which:

FIG. 1 shows a perspective view of a device 1 according to a first embodiment of the present invention. The device 1 is arranged to be handheld and is used to straighten pipes, especially elongate metallic pipes, such as copper pipes, which have been referred to previously.

The device 1 comprises four separate members 10, each of which is comprised of a substantially L-shaped elongate member. Both arms of the L-shape are preferably of the same length, although this is not essential. The members 10 are preferably formed from a substantially rigid, strong, material, such as mild steel, aluminium or a suitable plastics material.

Figure 1:
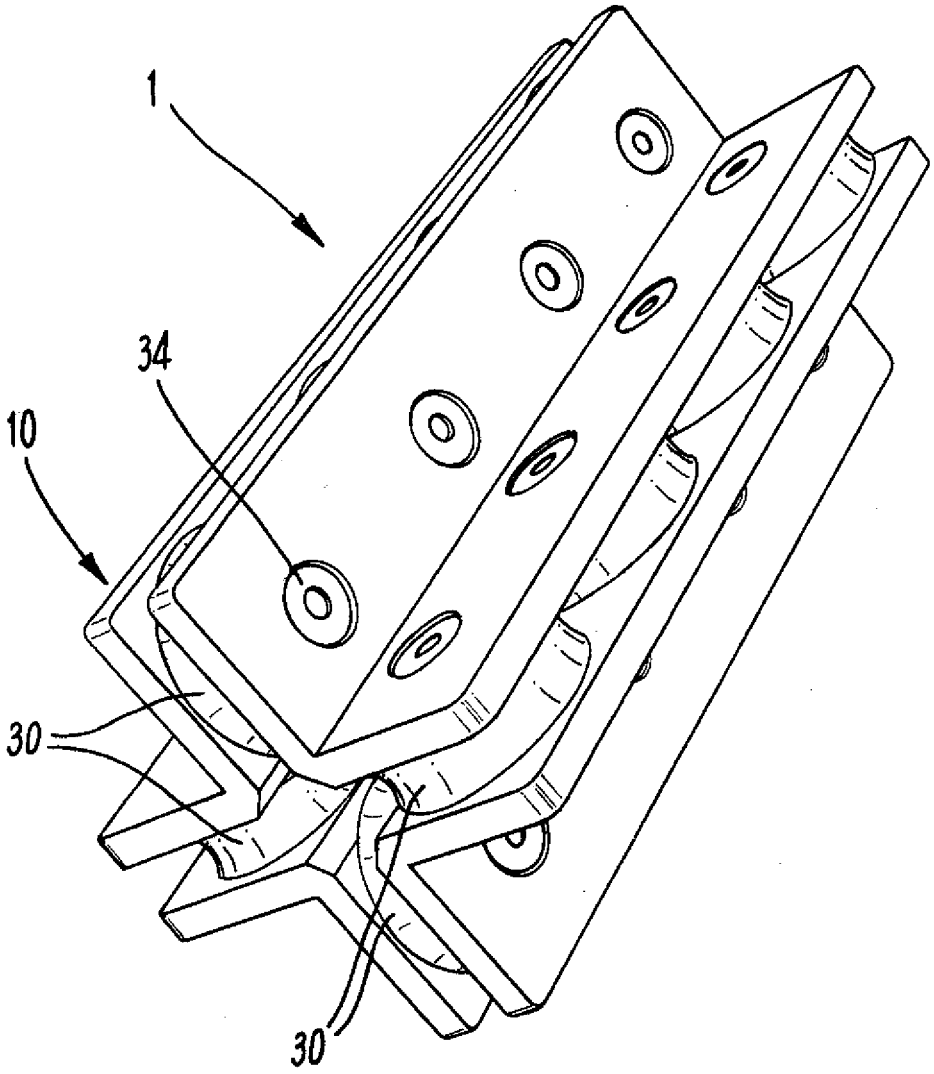
FIG. 1 shows a perspective view of an apparatus according to a first embodiment of the present invention.
Figure 2:
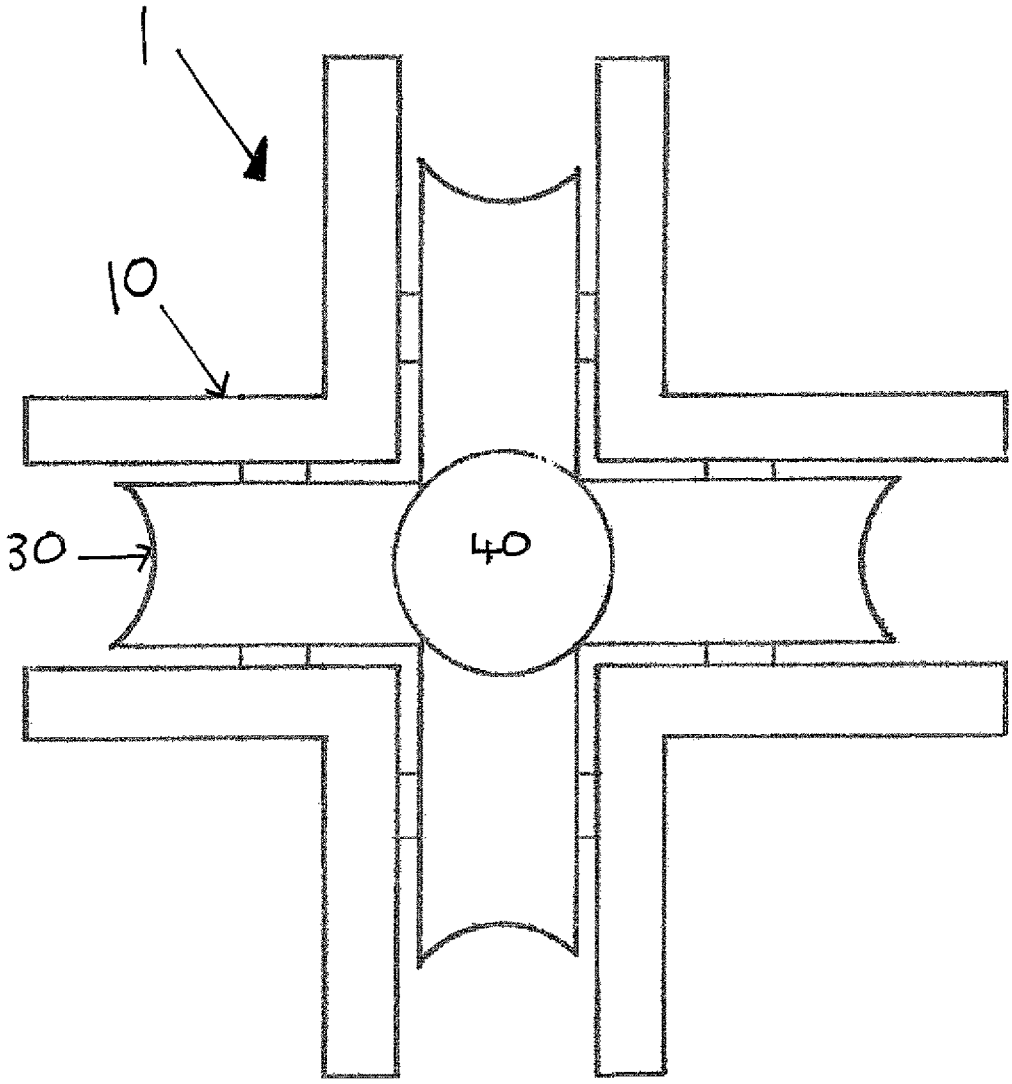
FIG. 2 shows an end view of the apparatus of FIG. 1.

The four members 10 are arranged in such a way that from an end, they resemble a plus-sign, as shown in FIG. 2. Disposed between each member 10 and its neighbour are a plurality of wheels. Each wheel is arranged on an axle 32 about which it may rotate. Each axle is coupled at each end to a respective member 10, thereby coupling all the members together securely. The coupling may be achieved by use of a screw or nut 34.

Each wheel 30 is provided with a circumference which is substantially concave, such that it conforms substantially with a section of the exterior surface of a tube or pipe.

When the device 1 is fully assembled, as shown in end view in FIG. 2, the edges of adjacent wheels 30 come together, or nearly come together, to define a substantially circular aperture 40 which is intended to conform to the outer profile of the pipe to be straightened.

Since pipes may come in a variety of different sizes, the actual dimensions of the various parts of the device 1 may be varied as required to suit a particular pipe.

Figure 3:
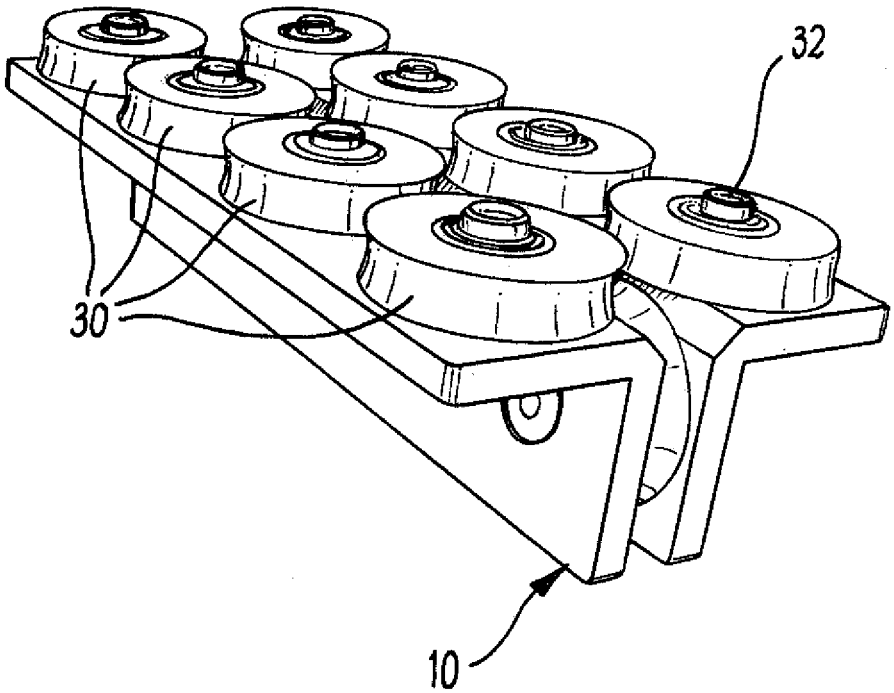
FIG. 3 shows a partly disassembled apparatus according to the first embodiment.

FIG. 3 shows clearly the orientation and positioning of the wheels 30 and members 10. The axles 32 in this view are coupled at their lower end to a respective member, and a wheel 30 is arranged to sit on the axle 32.

In use, the device 1 is arranged such that a free end of the pipe to be straightened is introduced into the aperture 40 of one end of the device. The device is then urged along the length of the pipe, and the manual force required to do this causes any bends in the pipe to be straightened out. It may be necessary to repeat the motion of the device along the pipe, back and forth, a few times to achieve the desired level of straightness. Once the desired effect is achieved, the device is simply removed and the pipe can be connected as required.

In some situations, it may be necessary to straighten a pipe when no free end is available. This could be because the pipe is already connected to a live system. In this scenario, a second embodiment of the present invention may be used. This is show in FIG. 4.

Figure 4:
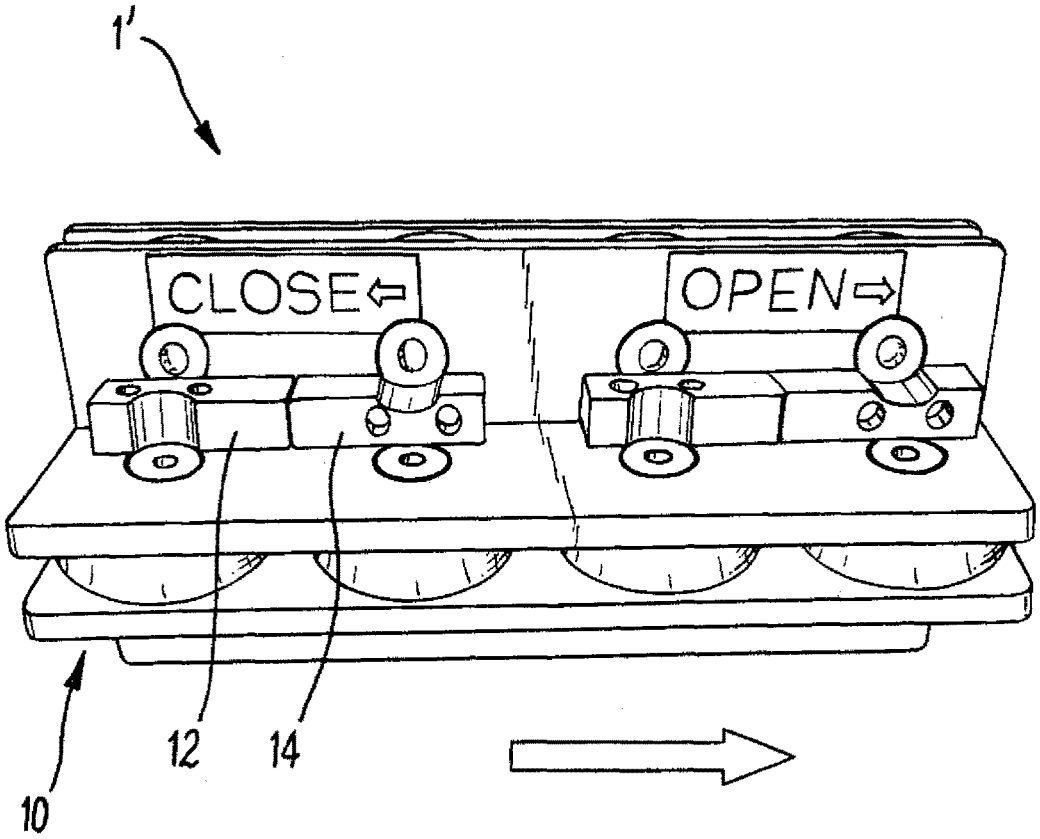
FIG. 4 shows an apparatus according to a second embodiment of the present invention, in a first configuration.

Here, device 1' comprises two separable halves 2. FIG. 4 shows the device 1' in its coupled configuration, in which it resembles very much the first embodiment already described. However, by moving the two halves 2 relatively apart in the direction of the arrow shown beneath the figure, it is possible to separate the two halves of the device.

Figure 5:
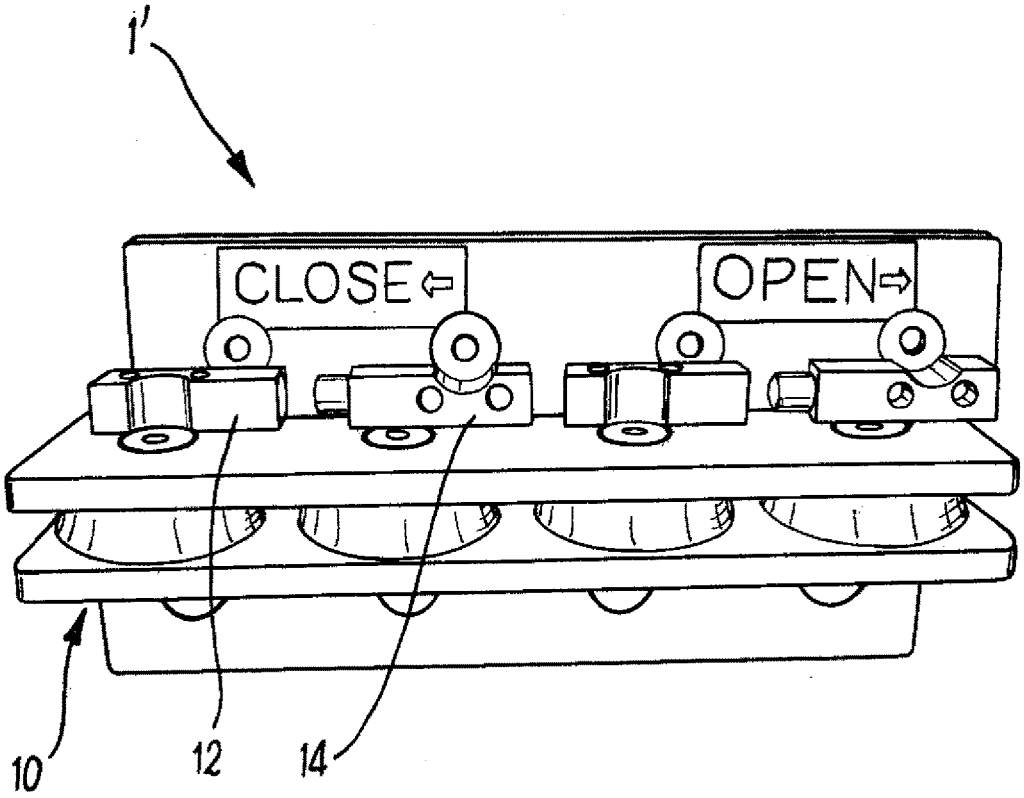
FIG. 5 shows the apparatus of FIG. 4 changing into a second configuration.
Figure 6:
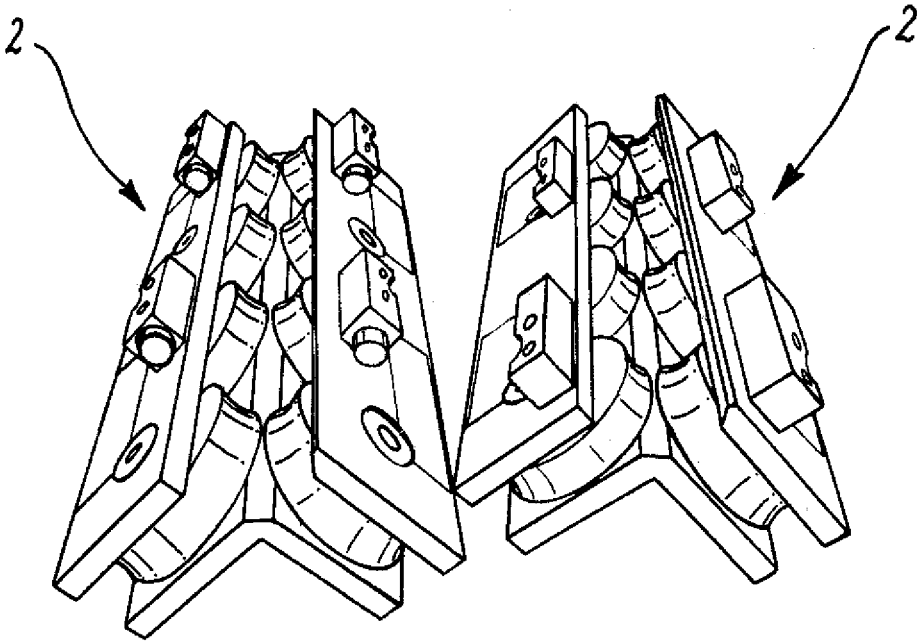
FIG. 6 shows the apparatus of FIG. 4 in the second configuration.

FIG. 5 shows the situation as the two halves are moved further apart such that full separation is possible. FIG. 6 shows the two halves 2, once separated.

The two halves 2 are connected together by means of paired connectors 12 and 14. The female connector 12 and the male connector 14 are arranged such that when connected, the device 1' is stable and can be used as has been described to straighten a pipe. Once the male and female connectors are separated, then the two halves may be positioned on either side of a pipe and then re-connected so that the device 1' is positioned surrounding the pipe exactly as if it had been positioned there from a free end of the pipe. Once the straightening operation has concluded, the two halves 2 may be separated as has been described and removed from the pipe.

The second embodiment has the clear advantage that it can be used in situations where the first embodiment simply could not gain functional access to the pipe which required straightening.

Figure 7:
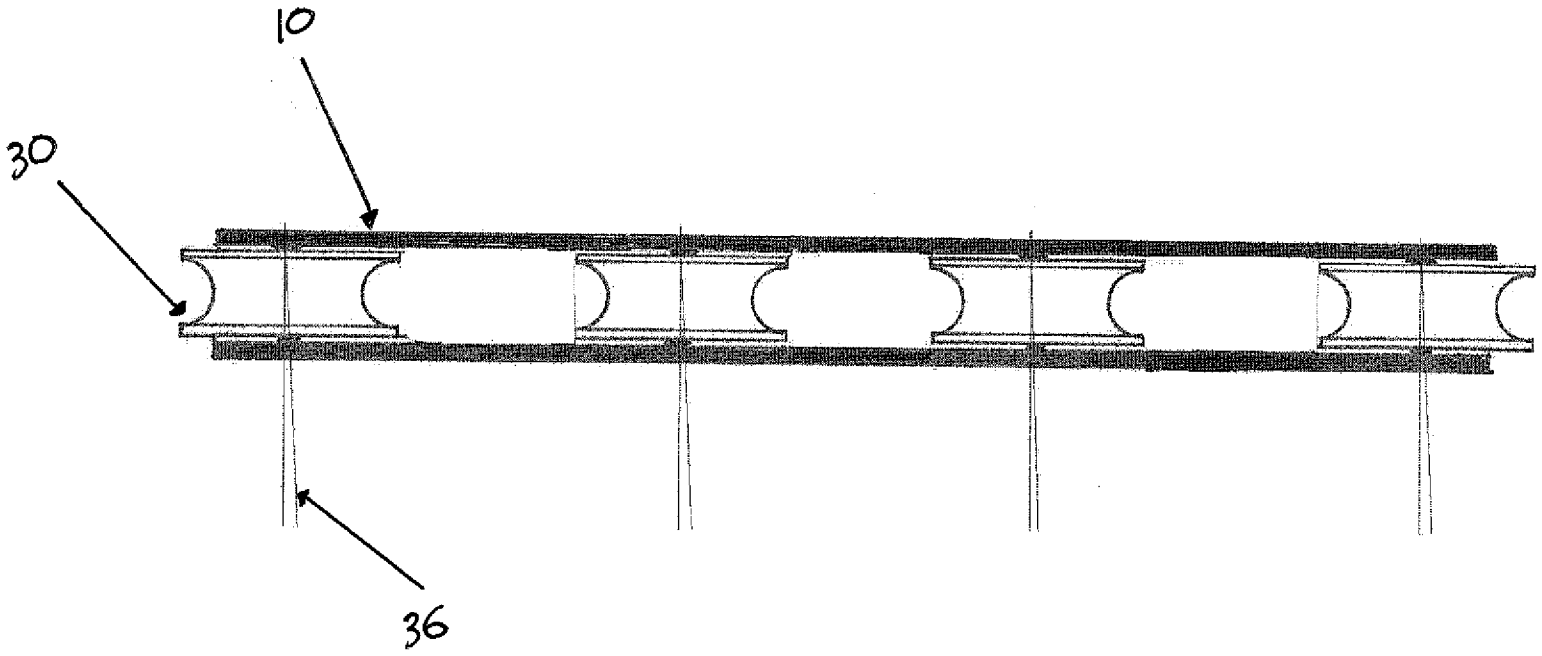
FIG. 7 shows an alternative configuration of a third embodiment of the present invention.

FIG. 7 shows an additional feature which can provide a further advantage and further improve the performance of the device. It may be applied to either of the embodiments described so far.

FIG. 7 shows a top view, looking down at the wheels 30 located between two members 10. This figure shows how the axes of the axles are offset from a line perpendicular to each member 10. The axis of the axle is represented by line 36, which can be seen to be non-perpendicular to each member 10.

The effect of this off-perpendicular axis is to cause the device 1 to rotate about the pipe as the device is propelled along the pipe. The deviation of the axis from the perpendicular determines the amount of rotation, but a deviation of a few degrees will cause the device to perform a complete rotation over a length of about 1 meter.

In use, then, the device 1 will appear to define a "corkscrew" shape along the length of the pipe being straightened, causing a greater surface area of pipe to be processed and producing a better result.

Of course, the embodiments described thus far are exemplary only and various modifications can be made, which still benefit from the overall invention.

Figure 15:
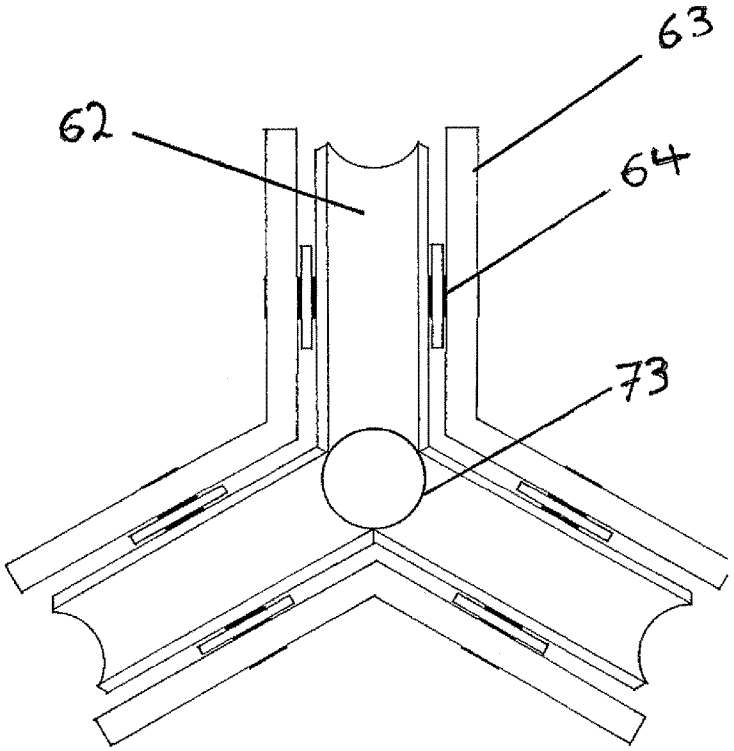
FIG. 15 shows an end view of an apparatus according to a fifth embodiment of the present invention.

For instance, the embodiment of the apparatus shown in FIG. 15 comprises three sets of wheels 62 which are positioned 120° from each other, unlike the 90° separation in the previous embodiments.

The apparatus features a frame comprising three angled members 63, each arranged in the form of a 120° angle bracket. Between adjacent members 63 are disposed a plurality of wheels 62, with the axles of said wheels joining together the members 63, as in the previous embodiments.

The wheels 62 define an aperture which conforms to the outer dimensions of the pipe to be straightened.

Figure 16:
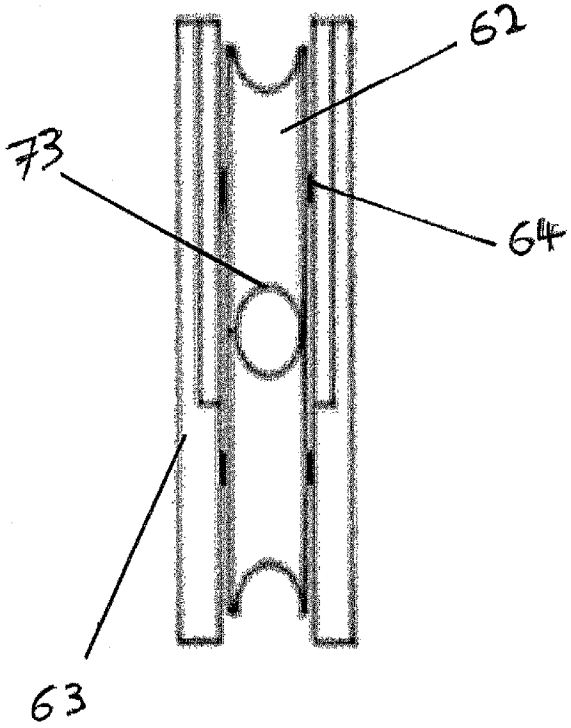
FIG. 16 shows an end view of an apparatus according to a sixth embodiment of the present invention.

The embodiment of the apparatus shown in FIG. 16 has a similar arrangement but with two sets of opposed wheels 62.

Referring to FIGS. 8 to 14 there is shown a pipe straightening apparatus 60 according to a fourth embodiment of the present invention.

The pipe straightening apparatus 60 is sized and configured to be hand held.

The pipe straightening apparatus 60 comprises a frame 61 and a plurality of wheels 62 rotatably mounted on the frame 61.

The frame 61 comprises four elongate members 63 having a substantially 'L-shaped' cross-section. The members 63 are preferably formed from a substantially rigid, strong, material, such as mild steel, aluminium or a suitable plastics material.

Figure 9:
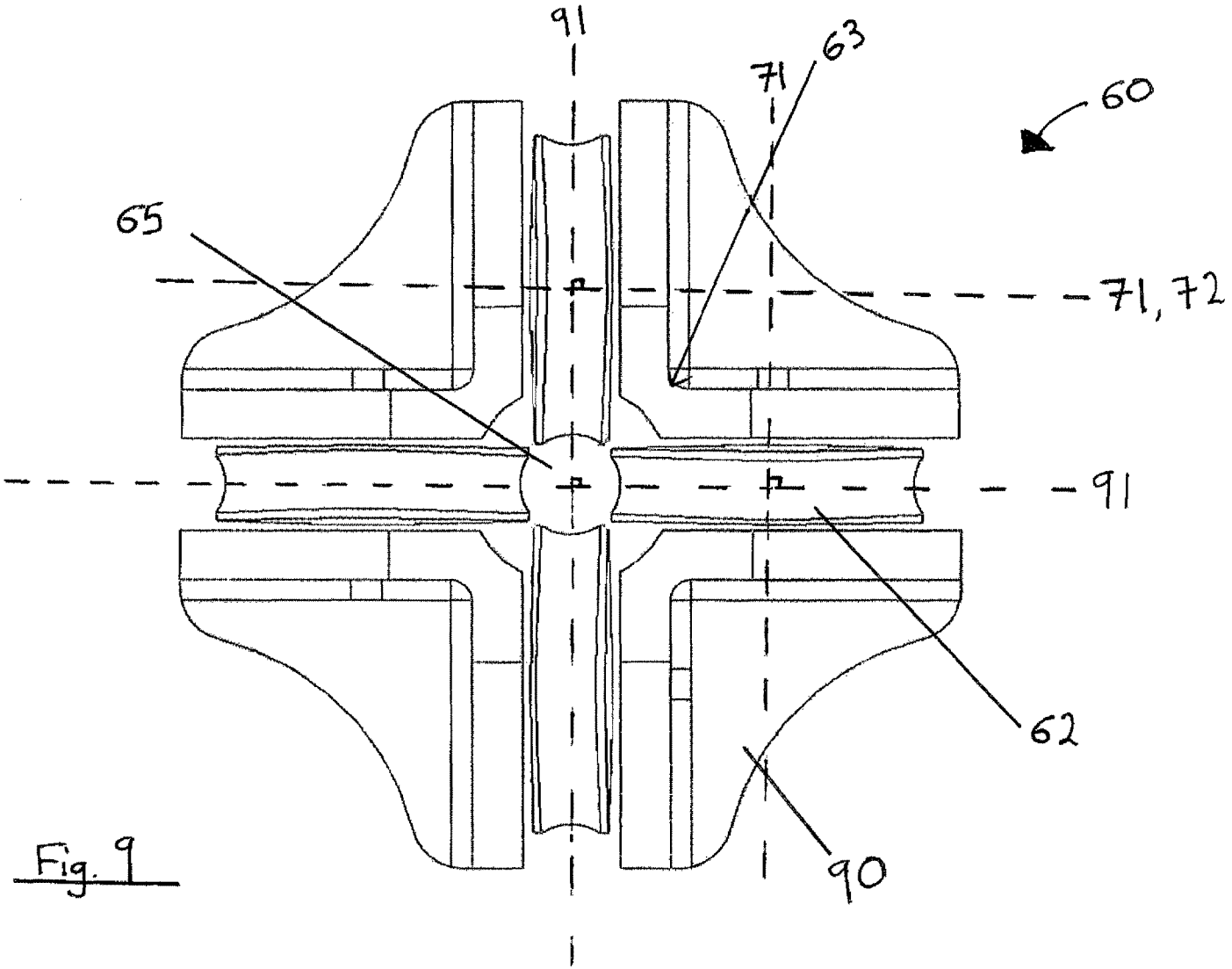
FIG. 9 shows an end view of the apparatus of FIG. 8, but with the pipe omitted for clarity.

The four members 63 are arranged in such a way that they resemble a plus-sign, as shown in FIG. 9. The wheels 62 are disposed between opposed surfaces of the members 63. Each wheel 62 is arranged on an axle 64, about which it may rotate. Each axle 64 is coupled at each end to a respective member 63, thereby coupling all the members 63 together securely. The coupling may be achieved by use of a screw or nut (not shown).

Webs 90 are provided between adjacent outer surfaces of each member 63, distributed lengthwise along the member 63, so as to strengthen and increase the rigidity of the frame 61.

Figure 14:
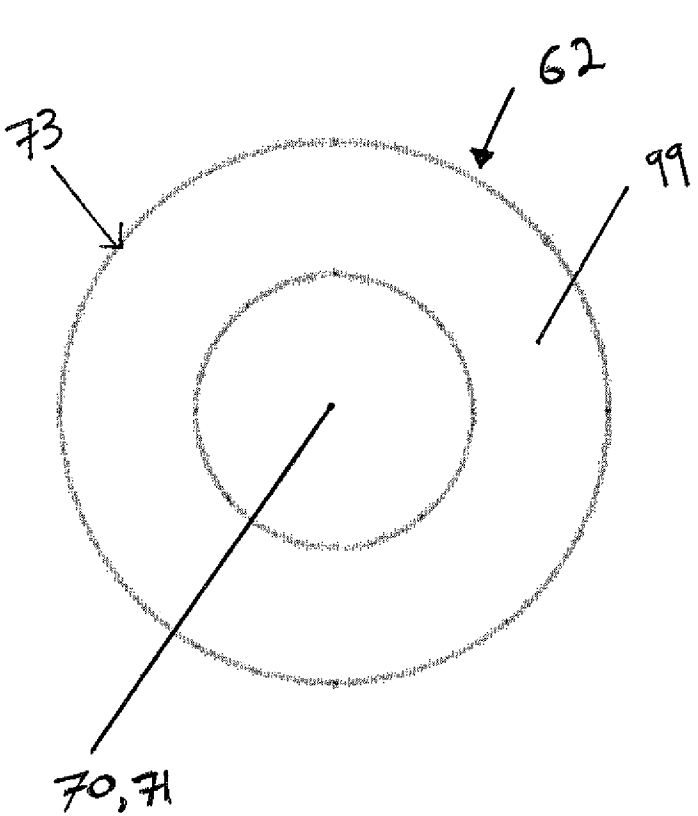
FIG. 14 shows a front elevational view of the wheel shown in FIG. 13.
Figure 13:
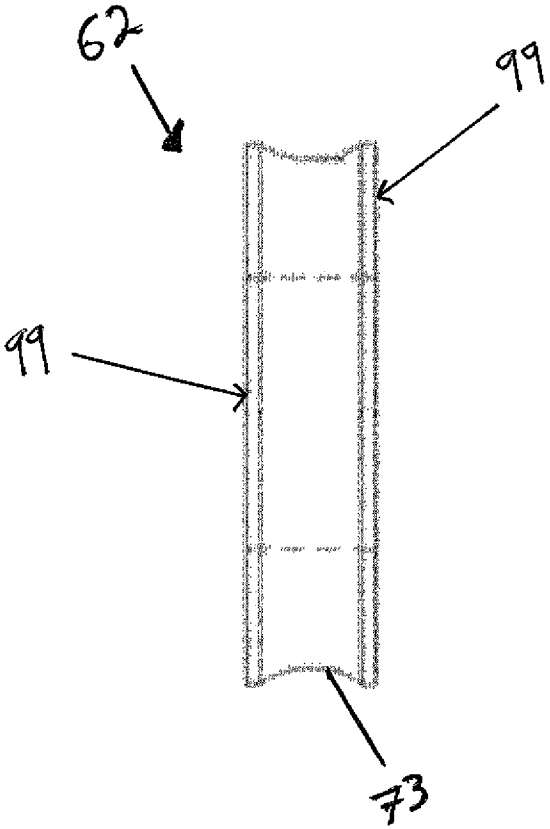
FIG. 13 shows an end view of one of the wheels of the embodiments of the apparatus shown in FIGS. 1 to 12.

With reference to FIGS. 13 and 14, each wheel 62 of the pipe straightening apparatus 60 (i.e. the wheels of both the first set and the second set (see below) has substantially circular front and rear surfaces 99 joined by a curved peripheral surface 73. The peripheral surface 73 is concavely curved and is of a substantially constant radius.

Figure 8:
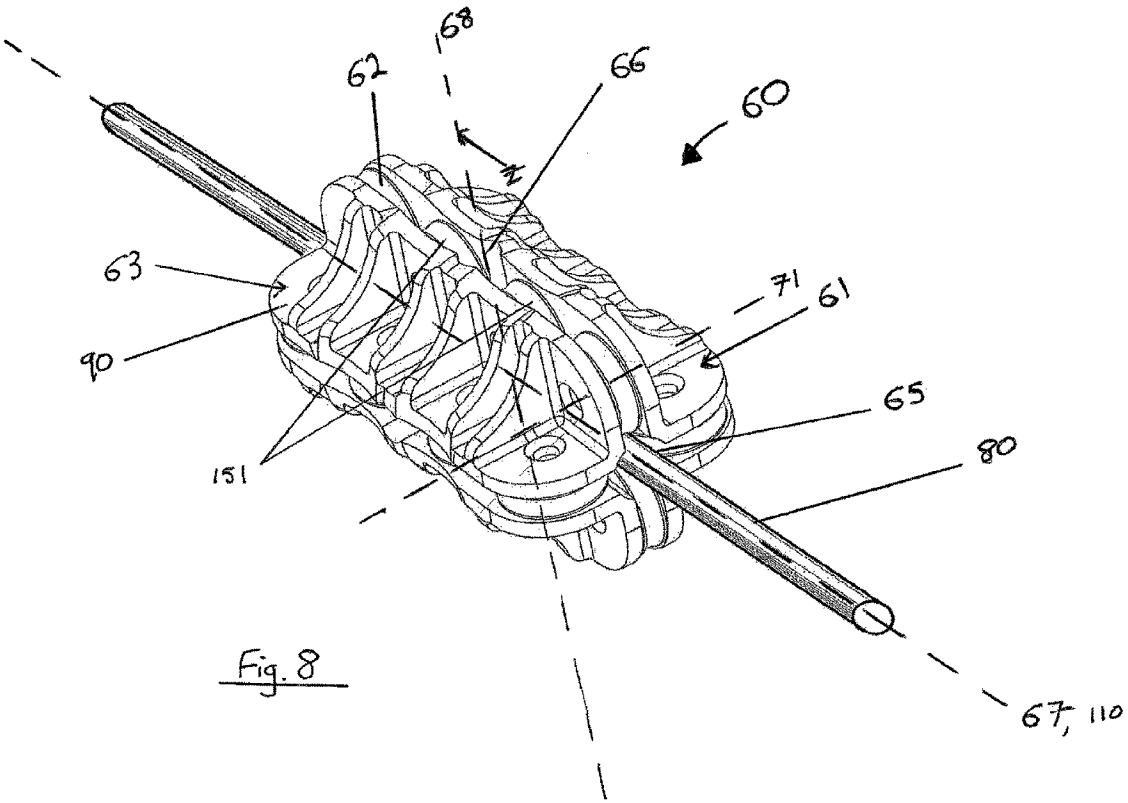
FIG. 8 shows a perspective view of an apparatus according to a fourth embodiment of the present invention, with a pipe received within a first passageway of the apparatus.

With reference to FIG. 8, the wheels 62 define a first elongate passageway 65 and a second elongate passageway 66 with respective longitudinal axes 67, 68. The longitudinal axes 67, 68 of the first and second passageways 65, 66 are substantially perpendicular to each other.

The first elongate passageway 65 is defined by a first set of the wheels 62. In the current embodiment, the first set of wheels consists of all of the wheels 62 of the apparatus. However, it will be appreciated that the apparatus may contain wheels that are not part of the first set and the first set may contain more, or fewer wheels than are shown.

Figure 11:
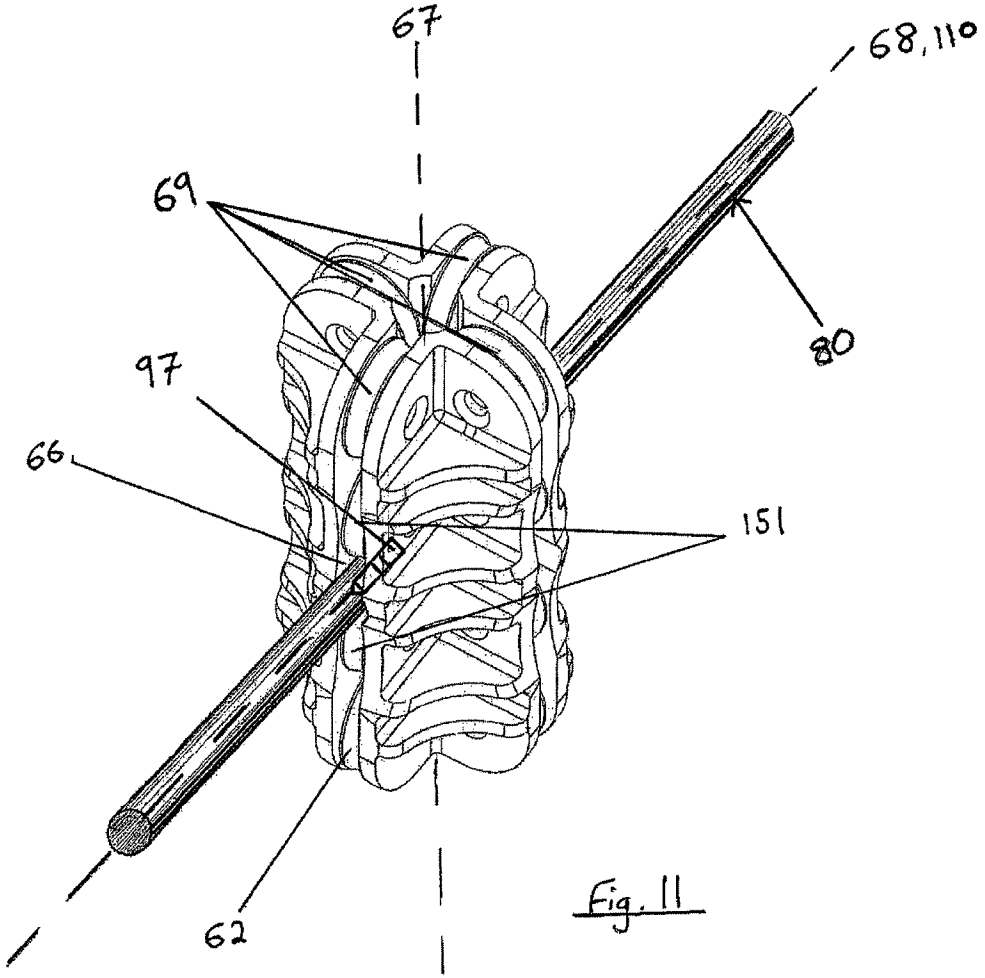
FIG. 11 shows a perspective view of the apparatus shown in FIGS. 8 to 10, with a pipe received within a second passageway of the apparatus.

The first set of wheels comprises a plurality of groups 69 of said wheels (one such group is labelled '69' in FIG. 11). The groups are distributed along the longitudinal axis 67 of the first passageway 56. Each group 69 of wheels comprises a plurality of wheels distributed circumferentially, and uniformly spaced, about said longitudinal axis 67, i.e. the wheels are distributed in the circumferential direction of an imaginary circle centred on the longitudinal axis.

The wheels of each group are aligned along a plane that is substantially perpendicular to said longitudinal axis 67. The centres 70 of the wheels 62 of each group 69 are aligned along a respective plane that is substantially perpendicular to said longitudinal axis 67.

The wheels in each group are arranged such that axes 91 that extend substantially perpendicular from the longitudinal axis 67 of the first passageway 65 and pass through the centres 70 of the wheels 62 intersect at the longitudinal axis 67 of the first passageway 65.

The respective curved peripheral surfaces 73 of the wheels 62 that face inwardly, towards said longitudinal axis 67, define a substantially circular cross-sectional shape, which is intended to conform substantially with a curved outer surface of a pipe to be straightened.

In the current embodiment, the first set of wheels comprises four said groups 69 of wheels and each group comprises four wheels 62. However, it will be appreciated that the number of wheels 62 in each group 69 may be varied. For example, FIGS. 15 and 16 show embodiments of the present invention where each group of wheels comprises 3 or 2 wheels 62 respectively.

Figure 10:
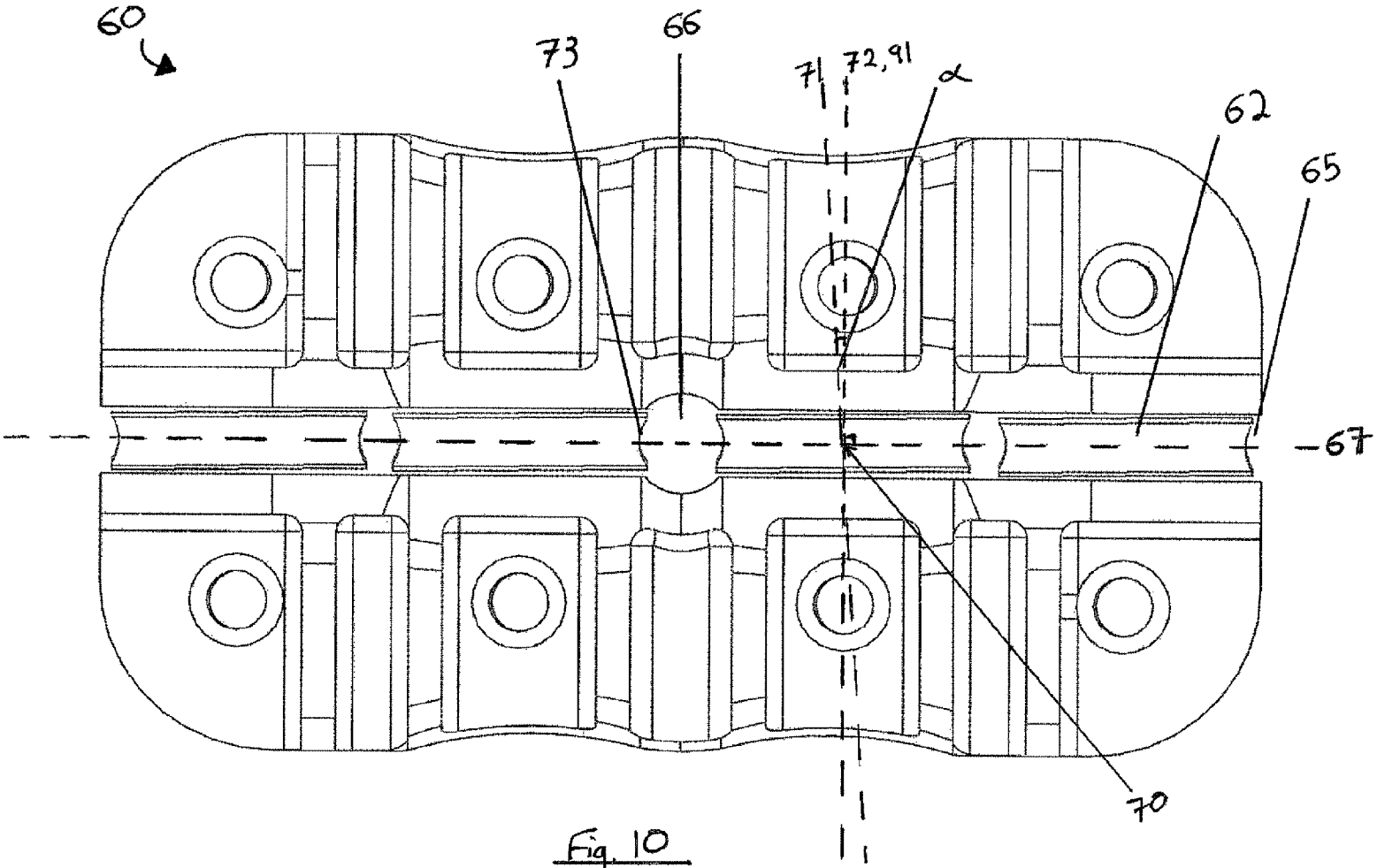
FIG. 10 shows a top down view of the apparatus shown in FIG. 8, but with the pipe omitted for clarity.

With reference to FIG. 10, the axis of rotation 71 of each wheel 62 of the first set is inclined at a non-perpendicular angle to the longitudinal axis 67 of the first passageway 65.

In this respect, the axis of rotation 71 of each wheel 62 of the first set is inclined at an angle ($\alpha$) relative to a line 72 that passes through the centre 70 of the respective wheel, is substantially perpendicular to the longitudinal axis 67 of the first passageway. Said line 72 is substantially perpendicular to an axis 91 that extends substantially perpendicular from the longitudinal axis 67 of the first passageway 65 and passes through the centre 70 of the respective wheel 62.

Said axis of rotation 71 is inclined from said line 72 in an anti-clockwise direction (looking towards the longitudinal axis) about said axis 91. It will be appreciated that the axes of rotation 71 could instead be inclined in a clockwise direction about said axis 91.

The axes of rotation 71 of each of the wheels 62 of the first set are inclined by substantially the same angle ($\alpha$) relative to said line 72 and in substantially the same rotational direction, i.e. in the same clockwise or anticlockwise direction, about said axis 91, when looking towards the longitudinal axis 67 of the first passageway 65.

In the current embodiment, the angle ($\alpha$) is 1 degree. The angle ($\alpha$) may be an acute angle. The angle ($\alpha$) is preferably in the range 1 to 2 degrees.

The axes of rotation 71 of the wheels are also inclined relative to the longitudinal axis 67 of the first passageway 65, i.e. said axes 71 are non-parallel to said longitudinal axis 67. This ensures that the wheels can translate in a direction which has a component in the direction of the longitudinal axis 67.

With reference to FIG. 9, the axis of rotation 71 of each wheel 62 of the first set is substantially perpendicular to the respective axis 91 that extends substantially perpendicular from the longitudinal axis 67 of the first passageway 65 and passes through the centre 70 of the respective wheel 62. Accordingly, the axis of rotation 72 of each wheel 62 is aligned within a tangential plane to a circle centred on the longitudinal axis 67 of the first passageway 65 (said circle having a radius equal to the distance of the axis 71 to the longitudinal axis 67).

The wheels 62 of each group 69 are arranged such that their respective opposed curved peripheral surfaces 73 are disposed at different circumferential positions relative to the longitudinal axis 67 of the first passageway and lie along a curve of substantially constant radius, that is centred on the longitudinal axis 67. The curved peripheral surfaces 73 of the wheels 62 in each group 69 are arranged to contact a pipe 80 in the first passageway 65 from different circumferential positions.

With reference to FIG. 8, the groups 69 of wheels are distributed along the longitudinal axis 67 of the first passageway 65. In this respect, the respective curved peripheral surfaces 73, of the wheels 62 of the first set, that face inwardly towards said longitudinal axis 67, lie along the curved surface of an imaginary cylinder. These surfaces 73 define lengthwise sections of the first passageway 65, which accordingly is elongate and has a substantially circular cross-section of substantially constant radius.

Accordingly, the pipe straightening apparatus 60 of the current embodiment is suitable for straightening pipes 80 with a substantially circular cross-sectional area. However, it will be appreciated that the shape of the peripheral surface 73 of the wheels 62 may be varied to match the outer shape of differently shaped pipes 80 as required.

With reference to FIG. 8, in order to straighten a pipe the pipe 80 is constrained to pass through the first passageway 65, i.e. the pipe 80 is translated within the first passageway 65, relative to the apparatus 60. It will be appreciated that, in order to achieve this relative movement, either the pipe 80 can be stationary and the apparatus 60 moved, or vice-versa, or both the pipe 80 and the apparatus 60 can be moved.

As the pipe 80 passes through the first passageway 65, the curved peripheral surfaces 73 of the first set of wheels 62 contact an outer surface of the pipe 80 and roll along the pipe 80.

These contacting surfaces 73 of the wheels 62, on the pipe 80, act to straighten out any bends, kinks, etc., in the pipe 80. Since the curved peripheral surfaces 73 of the wheels 62 in each group 69 contact the pipe 80 substantially around its entire circumference, this ensures that substantially the whole of the pipe 80 is straightened as it passes through the first passageway 65.

Since the axis of rotation 71 of each wheel 62 of the first set is inclined at a non-perpendicular angle to the longitudinal axis 67 of the first passageway 65, the apparatus 60 rotates relative to the pipe 80 as it translates relative to the pipe 80. Specifically, the wheels 62 roll along the pipe 80 in a direction which has a component in the circumferential direction of the pipe in the same rotational direction, i.e. in the same clockwise, or anti-clockwise, direction around the circumference of the pipe 80.

Accordingly, the wheels 62 of the first set define a "corkscrew" (i.e. helical) path as they roll along the pipe 80. This is advantageous in that a greater surface area of the pipe 80 is contacted, and straightened, by the wheels 80, thereby producing a better result.

In addition, sections of the pipe 80 located in any gaps in the circumferential direction, between the wheels 62, are straightened by the wheels 62 as they rotate about the pipe. This ensures that substantially the whole of the pipe 80 is straightened as it passes through the first passageway 65.

In the current embodiment, the first set of wheels comprises four groups 69 and each group 69 comprises four wheels 62. However, it will be appreciated that the number of groups and the number of wheels in each group may be varied.

The second elongate passageway 66 is defined by a second set of said wheels 62.

The second set of wheels comprises first and second groups of said wheels (one such group is labelled '151' in FIGS. 8 and 11). The first and second groups of wheels are distributed in the direction of the longitudinal axis 68 of the second passageway 66. Each group 151 of wheels comprises a plurality of wheels distributed circumferentially, and uniformly spaced, about said longitudinal axis 68 and aligned along a plane that is substantially perpendicular to said longitudinal axis 68. The centres 70 of the wheels 62 of each group 151 are aligned along a respective plane that is substantially perpendicular to said longitudinal axis 68.

The wheels 62 in each group 151 are arranged such that axes 91 that extend substantially perpendicular from the longitudinal axis 68 of the second passageway 65 and pass through the centres 70 of the wheels 62 intersect at the longitudinal axis 68 of the second passageway 66.

Respective curved peripheral surfaces 73 of the wheels 62 face inwardly, towards said longitudinal axis 68. The curved peripheral surfaces of the wheels in each group are arranged to contact a pipe in the second passageway from different circumferential positions.

The wheels of the second set of wheels also form part of the first set of wheels. In this respect, the first and second groups 151 of wheels of the second set are adjacent to each other, in the direction of the longitudinal axis 68 of the second passageway 66, and are disposed on opposite sides of the longitudinal axis 67 of the first passageway 65.

The axes of rotation 71 of the second set of wheels 62 are arranged such that when a pipe 80 is passed through the second passageway 66, the second set of wheels 62 roll along the pipe 80, relative to the pipe, in a direction which is substantially parallel to the longitudinal axis 68 of the second passageway 66 (and so substantially parallel to the longitudinal axis 110 of the pipe 80) and which does not have a component in the circumferential direction of the pipe, i.e. the apparatus does not rotate relative to the pipe as it translates relative to the pipe.

Figure 12:
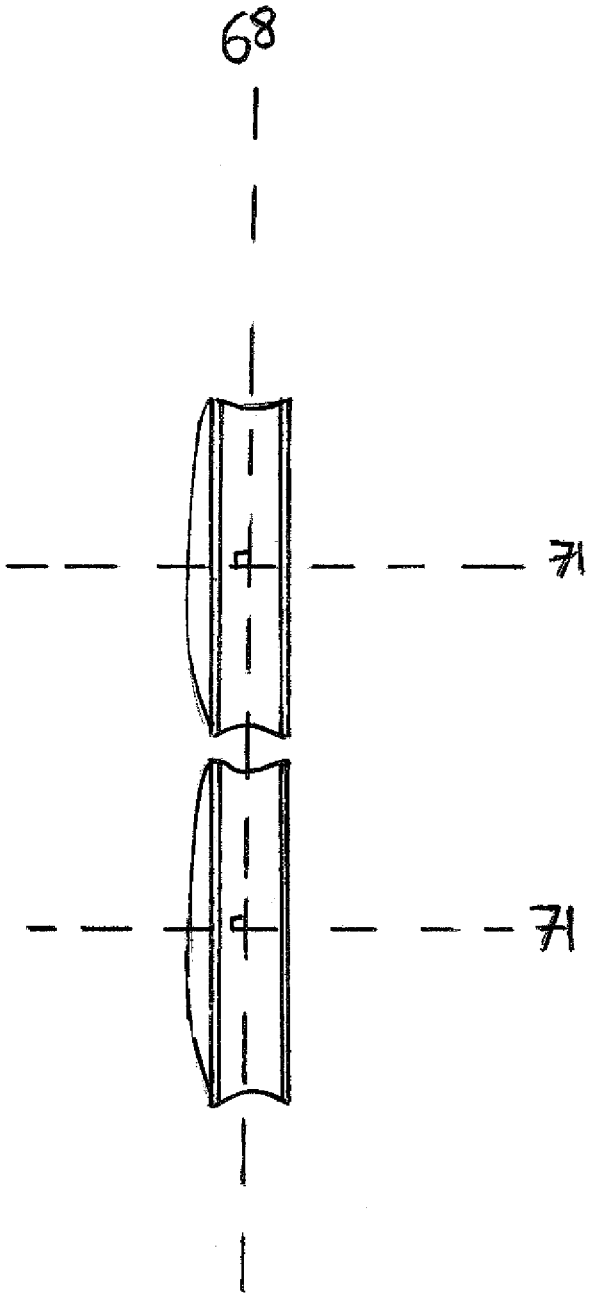
FIG. 12 is a view taken along the line 68 of FIG. 8, in the direction of arrow 'Z'.

The axis of rotation 71 of each wheel 62 of the second set is substantially perpendicular to the longitudinal axis 68 of the second passageway 66 (as shown in FIG. 12).

The axis of rotation 71 of each wheel 62 of the second set is substantially perpendicular to a respective axis that extends substantially perpendicular from the longitudinal axis 68 of the second passageway 66 and passes through the centre 70 of the respective wheel 62. Accordingly, the axis of rotation 71 of each wheel 62 is aligned within a tangential plane to a circle centred on the longitudinal axis 68 of the second passageway 66.

Since the wheels of the second set form part of the wheels of the first set, corresponding wheels in each group, that are aligned in the circumferential direction about the longitudinal axis 68 of the second passageway 66, are distributed circumferentially, and uniformly spaced, about the longitudinal axis 67 of the first passageway 65 and aligned along a plane that is substantially perpendicular to said longitudinal axis 67. Accordingly, respective curved peripheral surfaces 73 of said corresponding wheels of the second set also face inwardly, towards the longitudinal axis 67 of the first passageway 65, and define a substantially circular cross-sectional shape.

Therefore, the wheels of the second set define lengthwise sections of both the first and second passageways 65, 66.

Accordingly, the axes of rotation 71 of the wheels 62 of the second sets are inclined at a non-perpendicular angle to the longitudinal axis 67 of the first passageway 65 and are substantially perpendicular to the longitudinal axis 68 of the second passageway 66.

Furthermore, since the wheels of the second set form part of the wheels of the first set, the axis of rotation 71 of each wheel 62 of the second set is inclined (at said angle ($\alpha$)) relative to said respective line 72 as stated above for the first set of wheels. For each wheel, said axis of rotation 71 is inclined from said line 72 in an anti-clockwise direction (looking towards the longitudinal axis 67 of the first passageway 65) about said axis 91.

Accordingly, the axes of rotation 71 of wheels of the second set that are disposed on different sides of the longitudinal axis 67 of the first passageway 65 are inclined relative to the longitudinal axis 68 of the second passageway 66, in opposite rotational directions, about an axis that passes through the centre of the respective wheel and is substantially perpendicular to the longitudinal axis 68 of the second passageway 66 when looking towards the longitudinal axis 68).

Thus, when a pipe passes through the second passageway 66, the first and second groups of wheels of the second set are directed to travel in opposite rotational directions about the circumference of the pipe 80.

This is advantageous as it cancels out any rolling motion in the circumferential direction of the pipe, as the pipe passes through the second passageway. Accordingly, when a pipe is passed through the second passageway 66, the second set of wheels roll along the pipe, relative to the pipe, in a direction which is substantially parallel to the longitudinal axis of the pipe and which does not have a component in the circumferential direction of the pipe, i.e. the apparatus does not rotate relative to the pipe as it translates relative to the pipe.

Therefore, the apparatus may also be used to draw a substantially straight reference line on a pipe. Specifically, a marking means, in the form of a drawing implement 97 (e.g. a pen, pencil or the like) is attached to the frame of the apparatus and arranged to draw the path of the apparatus relative to the pipe, on the pipe.

Accordingly, since the apparatus does not rotate relative to the pipe as it translates relative to the pipe, the drawing implement draws a straight line on the pipe as a pipe translates within the second passageway, relative to the apparatus. The reference line can be used, for example, during subsequent bending of the pipe to ensure that a uniform bend is applied.

In the current embodiment, the second set of wheels comprises two groups 151 and each group 151 comprises two wheels 62. However, it will be appreciated that the number of groups and the number of wheels in each group may be varied.

Accordingly, the pipe straightening apparatus of the present invention is advantageous in that can conveniently be used to both straighten a pipe and to draw a substantially straight reference line along a pipe.

Both of the operations can be easily done by hand-held operation of the apparatus 60. In order to switch from the 'pipe-straightening' mode to the 'reference line drawing' mode, it is simply a case of removing the pipe 80 from the first passageway 65, rotating the apparatus 60 into a perpendicular orientation and passing the pipe 80 through the second passageway 66.

Since the first and second sets of wheels have shared wheels, this reduces the number of wheels necessary to perform both 'modes' of operation, thereby making the apparatus smaller and more convenient to use, which is an especially important advantage with a handheld apparatus. Costs savings also result.

Furthermore, the applicant has identified that as the wheels travel along the pipe, acting to straighten the outer surface of the pipe, a corresponding grooved passageway is created on the opposing region of the inner surface of the pipe. Accordingly, as the wheels spiral along the pipe, a spiral grooved passageway is created on the inside of the pipe. This is advantageous in that the passageway acts to direct liquid (e.g. water) flowing through the pipe. Accordingly, the liquid tends to flow in the direction of the spiral passageway, thereby creating a spiralling flow of liquid. This maintains the direction of flow of liquid through the pipe, which acts to maintain laminar flow, thereby reducing turbulence in the flow. Accordingly, energy lost to turbulent flow is decreased, as are the associated increase in drag forces created by turbulent flow. Therefore, less energy (i.e. a lower pressure differential) is required to maintain a certain flow rate through the pipe. The invention therefore not only straightens pipes, but also increases the efficiency of the pipes, resulting in improved economy of operation of the pipes.

In addition, the applicant has identified that where the at least one group of the first set comprises at least three rotatably mounted elements, the frictional forces between the rotatably mounted elements and the pipe being straightened are decreased, relative to a two wheel arrangement, due to the greater surface area of contact between the rotatably mounted elements and the pipe. Accordingly, the apparatus can be more suitable for hand held use, i.e. a person can propel the apparatus to translate relative to a pipe within the first passageway, so as to straighten the pipe.

The above embodiment is described by way of example. Many variations are possible without departing from the invention as defined by the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A pipe straightening apparatus comprising:

a first set of rotatably mounted elements which define, at least in part, an elongate first passageway through which a pipe can be constrained to pass, so as to straighten the pipe, wherein the axis of rotation of at least one of the rotatably mounted elements of the first set of rotatably mounted elements is inclined at a non-perpendicular angle to the longitudinal axis of the first passageway so that when the pipe translates within the first passageway, relative to the apparatus, the rotatably mounted elements of the first set of rotatably mounted elements roll along the pipe, relative to the pipe, in directions each having a component in the circumferential direction of the pipe; and a second set of rotatably mounted elements which define, at least in part, an elongate second passageway through which the pipe can pass, wherein the second set of rotatably mounted elements comprises at least one group of rotatably mounted elements disposed at mutually-opposed circumferential positions relative to the longitudinal axis of the second passageway and substantially aligned along a plane perpendicular to the longitudinal axis of the second passageway, wherein respective curved peripheral surfaces of each rotatably mounted element in the at least one group are arranged to contact the pipe at respective mutually-opposed circumferential positions relative to the pipe when the pipe is in the second passageway, wherein the second set of rotatably mounted elements comprises a plurality of said groups of rotatably mounted elements disposed at mutually-opposed positions along the longitudinal axis of the second passageway, wherein the second set of rotatably mounted elements are arranged such that when the pipe translates within the second passageway, relative to the apparatus, the second set of rotatably mounted elements roll along the pipe, relative to the pipe, in a direction that is substantially parallel to the longitudinal axis of the second passageway and the longitudinal axis of the pipe, and wherein the respective longitudinal axes of the first and second passageways are substantially perpendicular to one another.

2. A pipe straightening apparatus according to claim 1 wherein each axis of rotation of the at least one rotatably mounted elements of the first set is substantially perpendicular to an axis that extends substantially perpendicular from the longitudinal axis of the first passageway and passes through the centre of the respective rotatably mounted element.

3. A pipe straightening apparatus according to claim 2 wherein the axis of rotation of the at least one rotatably mounted elements of the first set is inclined relative to a line extending substantially perpendicular to the longitudinal axis of the first passageway, about an axis that is both substantially perpendicular to said line and to the longitudinal axis of the first passageway, in the same rotational direction when viewed looking towards the longitudinal axis of the first passageway.

4. A pipe straightening apparatus according to claim 1 wherein the first set of rotatably mounted elements comprises at least two rotatably mounted elements.

5. A pipe straightening apparatus according to claim 1 wherein respective curved peripheral surfaces of the rotatably mounted elements of the first set are arranged to contact a pipe in the first passageway from different circumferential positions relative to the pipe.

6. A pipe straightening apparatus according to claim 1 wherein said first set comprises at least one group of said rotatably mounted elements disposed at different circumferential positions relative to the longitudinal axis of the first passageway and substantially aligned in a direction substantially perpendicular to the longitudinal axis of the first passageway.

7. A pipe straightening apparatus according to claim 6 wherein respective curved peripheral surfaces of the at least one group of rotatably mounted elements define a substantially circular cross-sectional shape.

8. A pipe straightening apparatus according to claim 6 wherein said first set comprises a plurality of said groups, disposed at different positions along the longitudinal axis of the first passageway.

9. A pipe straightening apparatus according to claim 8 wherein corresponding rotatably mounted elements of different said groups are substantially aligned in the circumferential direction relative to the longitudinal axis of the first passageway.

10. A pipe straightening apparatus according to claim 1 wherein the axes of rotation of the rotatably mounted elements of the second set are either substantially perpendicular to the longitudinal axis of the second passageway or, where the axis of rotation of at least one of the rotatably mounted elements of the second set is not substantially perpendicular to the longitudinal axis of the second passageway, the axis of rotation of at least one other rotatably mounted element of the second set is inclined relative to the longitudinal axis of the second passageway so to counteract any rolling of the second set of rotatably mounted elements along the pipe, relative to the pipe, in a direction which has a component in the circumferential direction of the pipe, as the second set of rotatably mounted elements roll along the pipe.

11. A pipe straightening apparatus according to claim 1 wherein the axes of rotation of the rotatably mounted elements of the second set are substantially perpendicular to the longitudinal axis of the second passageway.

12. A pipe straightening apparatus according to claim 10 wherein the axes of rotation of the rotatably mounted elements of the second set are substantially perpendicular to respective axes that extend substantially perpendicular from the longitudinal axis of the second passageway and pass through the centre of the respective rotatably mounted element.

13. A pipe straightening apparatus according to claim 1 wherein the second set of rotatably mounted elements comprises first and second rotatably mounted elements disposed at different positions in the direction of the longitudinal axis of the second passageway, wherein said first and second rotatably mounted elements have axes of rotation in different directions so to counteract any rolling of the second set of rotatably mounted elements along the pipe, relative to the pipe, in a direction which has a component in the circumferential direction of the pipe, as the second set of rotatably mounted elements roll along the pipe.

14. A pipe straightening apparatus according to claim 1 wherein the respective curved peripheral surfaces of the rotatably mounted elements of the at least one group of rotatably mounted elements define a substantially circular cross-sectional shape.

15. A pipe straightening apparatus according to claim 1 wherein the first and second sets of rotatably mounted elements comprise at least one common rotatably mounted element.

16. A pipe straightening apparatus according to claim 15 wherein all of the rotatably mounted elements of the second set are also of the first set.

17. A pipe straightening apparatus according to claim 16 wherein the axes of rotation of the rotatably mounted elements of the second sets are inclined at a non-perpendicular angle to the longitudinal axis of the first passageway and are substantially perpendicular to the longitudinal axis of the second passageway.

18. A pipe straightening apparatus according to claim 1 wherein the apparatus comprises a marking means arranged to mark a pipe as it translates through the second passageway relative to the apparatus.

19. A pipe straightening apparatus according to claim 1 wherein the pipe straightening apparatus is sized and configured to be hand-held during use.

20. A method of use of a pipe straightening apparatus according to claim 1 comprising receiving a pipe within the first passageway of the apparatus, translating the pipe within the first passageway, relative to the apparatus, so as to straighten the pipe, receiving a pipe within the second passageway, translating the pipe within the second passageway, relative to the apparatus and marking a substantially straight line on the pipe as it passes through the second passageway.

21. A pipe straightening apparatus according to claim 1 wherein the rotatably mounted elements are wheels.

* * * * *